US007005625B1

(12) United States Patent
Mitchell

(10) Patent No.: US 7,005,625 B1
(45) Date of Patent: Feb. 28, 2006

(54) LOW POWER STABILIZED VOLTAGE DIVIDER NETWORK

(75) Inventor: Paul A. Mitchell, Lancaster, PA (US)

(73) Assignee: Burle Technologies, Inc., Wilmington, DE (US)

( * ) Notice: Subject to any disclaimer, the term of this patent is extended or adjusted under 35 U.S.C. 154(b) by 0 days.

(21) Appl. No.: 11/005,328

(22) Filed: Dec. 6, 2004

(51) Int. Cl.
*H01J 40/14* (2006.01)

(52) U.S. Cl. ..... 250/207; 250/214 VT; 313/532

(58) Field of Classification Search ..... 250/207, 250/214 VT; 313/532, 533, 103 R
See application file for complete search history.

(56) References Cited

U.S. PATENT DOCUMENTS 5,701,004 A * 12/1997 Nakaya ..... 250/207

* cited by examiner

*Primary Examiner*—Kevin Pyo
(74) *Attorney, Agent, or Firm*—Dann, Dorfman, Herrell and Skillman, P.C.

(57) ABSTRACT

A voltage divider network in combination with a voltage multiplier circuit voltage biases the electrodes of a photomultiplier tubes or related device. The circuit exploits the several voltage levels produced at successive stages of a voltage multiplier circuit in order to optimize the voltage divider network with respect to power consumption, current draw from the power supply, operating stability, and linear operation of the photomultiplier tube.

10 Claims, 10 Drawing Sheets

LOW POWER STABILIZED VOLTAGE DIVIDER NETWORK

FIELD OF INVENTION

The present invention relates to circuitry used in connection with photomultiplier tubes operated as radiation detectors. More particularly, the present invention relates to high-voltage power supplies and associated voltage divider networks with specific application for voltage biasing photomultiplier electrodes.

BACKGROUND

Photomultiplier tubes are commonly employed for detecting radiation and are found in a diverse range of applications including those related to spectroscopy, particle physics, astronomy, medical imaging and diagnostics, and laser ranging. Photomultiplier tubes are remarkable for their sensitivity, and in some situations can detect a single photon impinging on the photosensitive area of the photomultiplier tube. In addition, photomultiplier tubes are often favored over other types of detectors due to their high responsivity and low-noise characteristics. Further, photomultiplier tubes can be made with relatively large photosensitive areas which is advantageous in certain applications.

The operation of a photomultiplier tube is explained with reference to FIG. 1. FIG. 1 shows a typical photomultiplier tube 102 comprised of various electrodes situated inside an evacuated enclosure as delimited by a metal tube 104 that is sealed at one end with a stemplate 106 and at the opposite end with a transparent faceplate 108 or a glass envelope. There are many variations on the structure of photomultiplier tubes and on specific function of the components of photomultiplier tubes. The present invention is not specific to a particular type of photomultiplier tube, and is of general applicability to all photomultiplier tubes including those with focusing electrodes, multiple anodes, and multiple photocathodes. Therefore, the following description will be limited to aspects of photomultiplier tube structure and operation that are relevant to the invention and that are common to many types of photomultiplier tubes.

In FIG. 1, incident radiation 110 is admitted through a glass faceplate 108 or glass envelope to impinge on a radiation-sensitive photocathode 112. This causes the emission of one or a few electrons from the photocathode. A voltage bias provided by a voltage source 114 connected between the photocathode 112 and a dynode 116 in close proximity to the photocathode 112 creates an electric field between the photocathode 112 and said dynode 116. The electric field accelerates the electrons 118 that are emitted by the photocathode 112 in response to the radiation 110 incident upon it. The strength and polarity of applied voltage source 114 connected between the photocathode 112 and dynode 116 is such that the direction of the electric field forces electrons emitted from the photocathode to impact 116 with sufficient energy to cause the emission of additional secondary electrons 122. The electrons emitted from dynode 116 are accelerated toward a second nearby dynode 124 by an electric field created by a voltage imposed by voltage source 120 between dynode 116 and the second dynode 122. Upon impact with the second dynode 124, a number of electrons 128—greater in number than the secondary electrons 122 emitted from dynode 116 that impact 124—are emitted from dynode 124 and impact dynode 130. This process is repeated according to the number of dynodes, up to and including 132, creating a cascade of electrons that increases in number between successive dynodes. The electron cascade from the ultimate dynode 132 terminates when the electrons 134 emitted from 132, which is biased with respect to ground potential by voltage source 136, impact an anode 138, thereby inducing a current 140 in the anode that is sensed by an ammeter 142 or other external circuit. The anode current 140 thus serves as an indicator and measure of the radiation incident upon the photocathode.

It is noted that in order to create and sustain the electron cascade that is generated in response to absorption of radiation in the photocathode, each electrode (photocathode 112, dynodes 116, 124, 130, 132 and similar dynodes not shown, and anode 138) has a distinct and appropriate voltage bias with respect to adjacent electrodes.

It is further noted that the electron cascade constitutes an electric current between adjacent electrodes, that the electron cascade (118, 122, 128, 134 and corresponding electron cascades between electrodes not shown in FIG. 1) is amplified in that said electron current associated with each dynode pair increases proceeding from the photocathode to the anode. Moreover, the current between electrode pairs and the current supplied to each electrode varies with the intensity of radiation absorbed by the photocathode.

The use of separate independent voltage supplies, i.e., 114, 120, 126, 130 and the like, to bias the various electrodes as indicated in FIG. 1 is not commonly done due to the expense and complexity of using several high-voltage sources. Photomultiplier tubes often have between ten and twenty dynodes, and such a method of biasing would thus necessitate ten to twenty independent high-voltage sources. More typically, a single high-voltage source is utilized in combination with a voltage divider network that creates a succession of voltage levels. Each voltage level created by the voltage divider network is used to bias an electrode of the photomultiplier tube.

A simple recourse for realizing a voltage divider circuit is a passive network of resistors and capacitors. It is instructive to discuss the issues and performance limitations of such a resistance network in order to appreciate the advantageous features of the present invention. FIG. 2 shows a resistor divider network that produces a ladder of voltage levels that can be tapped to bias the photomultiplier tube electrodes as shown. The photomultiplier tube 202 of FIG. 2 is otherwise identical to that shown in FIG. 1, and includes a metal tube 204, a stemplate 206, a glass faceplate 208, a photocathode 210, a series of dynodes (212, 214, 216, 218, 220), and an anode 222.

To further elaborate the circuitry of FIG. 2, a high voltage supply 224, powered by a line voltage 226, creates a negative high voltage −HV with respect to ground 230. Configuring the photomultiplier tube such that the anode 222 is common or close in potential to ground and the photocathode 210 is biased at a high voltage with respect to the anode is the preferred way of biasing the photomultiplier tube since it simplifies the interconnection of anode current sensing circuitry that is indicated functionally as a ammeter 232 between the anode 222 and ground 230. However, neither the explanatory discussion herein, nor the present invention is specific to a particular polarity of photomultiplier tube biasing.

In FIG. 2, a string of series-connected resistors (232, 234, 236, 238 . . . . . 240) is connected across the negative high potential 228 and ground 230. The resistance values of these resistors can be chosen to realize an appropriate voltage differences (V0, V1, V2, V3 . . . . . VN) between each electrode. If all the resistors are of equal resistance value, then the voltage differences between adjacent electrodes are nominally the same for all electrodes. On the other hand, the resistor values can be chosen to produce various and distinct voltage differences between specific electrode pairs.

In operation of the photomultiplier tube of FIG. 2 as a detector, radiation 252 is admitted through glass faceplate 208 to impinge on photocathode 210. Similar to that described with respect FIG. 1, radiation incident on the photocathode 210 creates a current IK of secondary electrons. Here, the normal convention for current as the flow of positive charge is adapted, and therefore, the current direction indicated for IK is opposite the flow of negatively charged electrons. Analogous currents, I1, I2, I3, etc., constituting successive stages of the electron cascade initiated by the secondary electrons ejected from the photocathode 210 in response to incident radiation 252, exist between each pair of electrodes and culminate in an anode current IA as shown. IA is measured by a current sensing device 232.

The voltage differences (V0, V1, V2 . . . . . VN) between adjacent electrodes, as determined by the voltage divider circuit comprised of resistors R1, R2, R3, . . . RN, partly determines the gain G for each pair of electrodes, where the component gains associated with each electrode pair are defined as $$G1=I1/IK;\ G2=I2/I1;\ G3=I3/I2,$$

and so forth, and including GA=IA/IN. Further, the quantum yield G0 of the photocathode 210 may be defined as the ratio of the photocathode current IK to the flux of photons comprising the radiation 252 incident on the photocathode 210.

The overall gain G of the photomultiplier tube is then the product of the gains associated with each stage of the electron cascade and the quantum yield of the photocathode.

$$G=G0*G1*G2* \ldots\ldots\ldots GN*GA$$

An objective in the design and operation of the photomultiplier tube is to realize a high overall gain, thus achieving high sensitivity and high response. A further objective, and practical limitation, is to operate the photomultiplier tube with a gain that does not depend on the intensity of radiation incident on the photocathode. A constant gain, independent of incident radiation, is necessary for linear operation of the photomultiplier tube so as to avoid distortion effects. In practice, the gain between electrodes may saturate at relatively high incident radiation levels in that an incremental increase in primary electrons impacting an electrode produces a diminishing corresponding increase in secondary electrons emitted and collected by an adjacent electron. This saturation of gain may be due to space-charge effects around the electrode at high electron cascade currents. Another cause of varying gain and saturation is variable voltage biases (V0, V1, V2, . . . . VN) between the electrodes. Specifically, the voltage difference between adjacent electrodes changes with radiation intensity on the photocathode. This can be most directly appreciated by noting that the currents (IR0, IR1, IR2 . . . . IRN) through each resistor (232, 236, 238, . . . . 240) depend on the corresponding electrode currents (IK, ID1, ID2, ID3, ID4, . . . . IDN), which result from the secondary electron currents (IK, I1, I2, ID3 . . . . IA, between adjacent electrodes. The secondary electron currents are determined by the gains (G0, G1, G2, G3 . . . GA) of the corresponding stages between electrodes which in turn depend on the voltages V0, V1, V2 . . . VN.

To summarize, in typical operation of the photomultiplier tube, the voltage difference between adjacent electrodes will not be fixed solely by the resistor values of the voltage divider network. The appreciable current of secondary electrons between each electrode modifies the effective load of the electrode pair in parallel with each resistance (R0, R1, R2, . . . RN) of the voltage divider network. Thus, the currents (IR1, IR2, IR3, . . . . IRN) through each resistor of the voltage divider network will depend on the secondary electron current between electrodes. This in turn will depend on the light intensity, since the electron cascade is initiated by secondary electrons emitted from the photocathode in response to irradiation. A consequent and problematic aspect of the variable currents in the resistors due to varying radiation intensity is the resultant variable voltage differences between electrodes. Since the gain associated with each electrode pair depends on the voltage differences between electrodes, which in turn depends on the secondary electron cascade current, the anode current will no longer be proportional to the radiation intensity impinging on the photocathode. Such non-linear effects will result in signal distortion. Thus, an objective in designing photomultiplier tube bias circuits is to desensitize the voltage differences between adjacent electrodes to variations in incident radiation intensity, thereby assuring an adequate constant gain independent of operating levels for the intended range of operation.

One means to reduce the sensitivity of gain to incident radiation levels is to select resistor values (R0, R1, R2 . . . . RN) of the voltage divider network such that the currents (IR0, IR1, IR2, IR3, . . . . IRN) are much greater than the electrode currents (IK, I1, I2, I3, . . . . IN, IA) expected to be encountered for the intended specific application. As a rule of thumb, a linear response of the photomultiplier tube that is adequate for many applications can be achieved if the electrode currents are less than about 1% of the currents (IR1, IR2, IR3 . . . IRN) through the resistors (R0, R1 R2, . . . . RN) that establish the voltage biases of the electrodes. In practice, this imposes a maximum operating level for the photomultiplier tube. This maximum operating level for linear operation can be specified in terms of the maximum allowable incident radiation intensity, or considering the overall gain, in terms of the maximum allowable anode current.

A further consideration is that the current through resistors R0, R1, R2, . . . RN of the voltage divider must be supplied by the high-voltage power supply. The specification of currents through resistors R0, R1, R2, . . . RN will determine the required capacity of the high-voltage power supply used to source the voltage divider network. A high capacity power supply adds expense to the use of the photomultiplier tube so there is incentive to minimize the current through the resistors of the voltage divider network. Further, the high currents involved may necessitate some means of cooling to avoid unwanted heating effects. This design objective—namely, reducing the current drawn from the high voltage power supply—is at variance with increasing the voltage divider network currents in order to avoid saturation effects. Thus, a trade-off is evident in the design of photomultiplier tube biasing circuitry and the design must be a compromise between reducing power consumption and assuring stable, linear behavior over a wide range of operation. The present invention describes circuitry that provides a more favorable compromise in satisfying these two conflicting design objectives.

More sophisticated voltage divider networks can ameliorate some of the saturation problems due to the voltage-bias-dependent gain between electrodes varying with the intensity of the incident radiation. A basic criterion in the design of photomultiplier tube voltage biasing circuitry is to extend the linear operating range of the photomultiplier tube by employing a voltage biasing scheme that maintains constant electrode voltage biases over a wider range of incident radiation levels, or correspondingly, over a wider range of electrode currents. Another design criterion is to avoid high currents drawn from the high-voltage power supplies which otherwise would add undue expense and complexity.

It will be noted that the anode and the dynodes close to the anode have higher currents relative to that of the photocathode and dynodes close to the photocathode. Thus, the problem of gain saturation and non-linear response discussed above is most critical and appears first in these electrodes. Therefore, circuit designs intended to improve linearity and operating range should firstly address the variation of electrode voltage bias with radiation intensity for the anode and electrodes closest to the anode. Further, it is the currents in these electrodes that most burden the power supply capacity.

FIG. 3 shows a photomultiplier tube 302 comprised of metal tube 304, stemplate 306, glass faceplate 308, photocathode 310, dynodes 312, 314, 316, 318, 320, and 322, and anode 324. A high voltage supply 326 powered by a line voltage 328 creates a high negative voltage –HV with respect to ground 332. The voltage biases for the electrodes in the vicinity of the photocathode are established by resistors 336, 338, 340 and so forth, as in the circuit of FIG. 2.

In distinction to the circuit of FIG. 2, in the circuit of FIG. 3 the voltage biases between the anode 324 and its nearby dynodes 318, 320, and 322 are established by reverse-biased Zener diodes 342, 344, and 346. Within a specified range of currents, a reverse-biased Zener diode will maintain a nominally constant voltage across its output terminals that is independent of the current. Thus, a more constant voltage bias is achieved for those electrodes that are most susceptible to saturation effects associated with relatively high electrode currents. A drawback to the use of Zener diodes is their noisy characteristics at low current and low voltage bias levels. Further, the fixed breakdown voltage of a Zener diode that establishes the bias between electrode pairs does not adjust to changes in power supply voltage. Thus, the voltage distribution among the electrodes may become highly imbalanced when the high voltage supply output level is greatly varied.

FIG. 4 shows a photomultiplier tube with a voltage divider circuit with active loads. The photomultiplier tube 402 is identical in structure and function to the photomultiplier tubes shown in FIGS. 1, 2, and 3 and is powered by a high-voltage source 424 energized by a line voltage 426. The terminology 'active' signifies the use of transistors to form the loads of the voltage divider circuit, as opposed to passive loads comprised solely of resistors or capacitors. As in the circuit of FIG. 3, the biases for the photocathode 450 and the dynodes 452 and 454 near the photocathode are adequately established by resistors 428, 430, and 432. As the current levels in these electrodes do not reach the high levels seen in the electrodes near the anode, the use of resistor loads is normally adequate to avoid saturation effects.

The sections of the voltage divider network that establish the bias for the anode 464 and the dynodes 456, 458, 460, and 462 near the anode, i.e., in the last stages of the secondary electron cascade, are more susceptible to variations in electrode bias with incident radiation intensity. Therefore, the circuit of FIG. 4 utilizes transistors 434, 436, and 438, to provide a more constant voltage bias than is typically achieved with a passive resistor network. Transistors 434, 436, and 438 are connected in a modified emitter-follower configuration and serve as buffers to regulate the voltage difference (between the collector and emitter of each transistor) across the corresponding pair of electrodes. Briefly, as the load presented by an electrode decreases with increasing secondary electron cascade currents (i.e., increasing incident radiation intensity), the emitter-base voltage of each transistor increases to provide more transistor emitter current and thus oppose changes in the collector-emitter voltages of the transistors. To a first order, the base voltages of transistors 434, 436, and 438 are established by the voltage divider comprised of resistors 442, 444, 446 and 448. Since the base currents of transistors are typically a hundred times smaller than the collector or emitter currents, the base voltages are comparatively resistant to changes in the electrode loading. A compensating negative feedback that opposes changes in collector-emitter voltage of the transistors is provided by resistor 440, wherein increases in the electrode current resulting from decreasing electrode load as the secondary electron cascade current increases, cause the emitter-base voltage to increase. This leads to an increase in emitter current as needed to maintain a constant collector-to-emitter voltage. Specific to the circuit of FIG. 4, as the load between dynodes 450 and 452 decreases, the combined impedance between node 454 and node 456 decreases. The corresponding voltage drop at node 456 results in an increase in voltage difference between node 458 and 456, which is the emitter-base voltage of transistor 434. The increased emitter-base voltage of transistor 434 leads to an increased emitter current that compensates for the increased current drawn by the dynodes 450 and 452.

There are several variations on voltage divider circuits as exemplified by FIG. 4, that include capacitors, diodes, Zener diodes, and field-effect transistors in place of bipolar transistors.

SUMMARY OF THE INVENTION

The present invention describes a circuit, and variations thereof, that provide the several voltage bias levels needed to operate a photomultiplier tube. Photomultiplier tubes have a plurality of electrodes and each electrode requires a distinct voltage bias level. The voltage bias levels may be as high as several thousand volts with respect to the normally grounded anode. To bias the electrodes, photomultiplier tubes typically rely on a single power source used in combination with a voltage divider network. The voltage divider network may be comprised of resistors, capacitors, Zener diodes, and transistors.

The optimal biasing requirements of each electrode are distinct because under typical operating conditions the loads that each of the electrode pairs present to the voltage divider network are not the same. Due to the nature of the secondary electron cascade amplification effect, the photocathode and dynodes near the photocathode will exhibit relatively smaller electrode loading currents compared to the loading currents of the anode and dynodes near the anode. Further, the loads presented by each electrode will, in general, vary during the course of measurements, especially as the incident radiation varies. The anode and dynodes close to the anode exhibit the highest currents in response to radiation incident on the photocathode, and therefore these electrodes are most susceptible to saturation effects, wherein the voltage difference between adjacent electrodes, and consequently the gain associated with those electrodes, changes with the radiation intensity incident on the photocathode. Passive resistor networks, as commonly employed for biasing photomultiplier tubes, often prove inadequate for avoiding such saturation effects. An important design criterion for photomultiplier tube biasing circuitry is the resilience of the bias voltages imposed between electrodes to changes in radiation levels during operation of the photomultiplier tube as a radiation detector. Another consideration is to minimize the current drawn from the high-voltage source used by the voltage divider network as increased capacity of the power supply adds expense, bulk, and possibly, additional cooling requirements.

The present invention offers several photomultiplier tube voltage biasing circuits that provide more latitude in tailoring the voltage divider circuit for better optimization, and that will result in reduced power consumption, wider linear operating ranges, and better stability. The improvements in performance are gained in two ways. First, it is recognized that the various intermediate voltage levels available from voltage multiplier circuits can be used to improve the performance of the voltage divider network. Specifically, instead of using solely the maximum output voltage of the voltage multiplier circuit and creating a succession of voltage levels from the maximum voltage using a voltage divider circuit, the intermediate voltage levels of the several stages of the voltage multiplier circuit are used to power subsections of the voltage divider network. This approach is based on the idea that the voltage divider network can be partitioned into several subsections to better optimize its performance, especially if these subsections of the voltage divider network can be separately and independently sourced by intermediate voltage output levels of a multistage voltage multiplier circuit.

For the case of partitioning the voltage divider circuit into two sections, there is then a 'front-end' section that generates voltage levels to bias the photomultiplier tube photocathode and the dynodes near the photocathode, and a 'back-end' section of the voltage divider circuit that serves to bias the photomultiplier tube anode and dynodes near the anode. The electrode currents and loading of photocathode and dynodes biased by the front-end section are relatively low, and thus, a resistor network is adequate to avoid saturation effects. The resistors comprising the voltage divider network for the front-end section can be of relatively high resistance values in order to minimize the current drawn from the high voltage multiplier.

The 'back-end' section of the voltage divider network that is used to bias the anodes and the dynodes near the anode can be optimized separately from the front-end section of the voltage divider network. This is useful since the anode and nearby dynodes have operating characteristics and performance issues distinct from the electrodes biased by the front-end resistor voltage-divider network. Specifically, in normal operation the anode and adjacent dynodes draw relatively larger load currents and are more susceptible to saturation effects than the photocathode and its adjacent dynodes.

The partitioning of the voltage divider circuit into sections and the use of intermediate voltage levels produced by stages of the voltage multiplier circuit to source sections of the voltage divider network, and thus permit their separate optimization, can considerably reduce the power drawn from the voltage multiplier. By partitioning the voltage divider network in two sections, the operating power consumption can be reduced by almost a factor of two.

This separate optimization of the front-end and back-end sections of the voltage divider networks is facilitated by using intermediate voltage outputs from the several stages of the voltage multiplier circuit. The main benefit of such an optimization is to reduce the total power drawn from the high-voltage power supply and improve the stability and operating range of the photomultiplier tube. To gain further reductions in power consumption, this approach can be extended, and the voltage divider circuit can be partitioned into three or more sections, each section sourced by an intermediate voltage level from the voltage multiplier circuit.

The backend section of the voltage divider circuit performs better when transistor loads are used. A transistor load, connected in an emitter follower configuration counters changes in load voltage with load current. Thus, the onset of saturation effects can be delayed as the radiation intensity increases. The optimization of series-connected transistors as a backend voltage divider network is also facilitated by the ability to source sections of the voltage divider network with intermediate voltage levels provided by the various stages of the voltage multiplier circuit.

Another aspect of the voltage divider that uses transistor loads as described above is improved upon by the present invention. In particular, a ladder of series-connected transistors are clamped by a current source such that the emitter current is approximately constant, independent of the electrode load. The current source fixes the biases across electrode pairs that is, to a good approximation, independent of the voltage used to source the string of transistors. Thus, the optimum transistors can be set relatively independent of the high voltage source and as a consequence, no safety margin needs to be designed into the voltage divider circuit for operating at reduced source voltage levels. By eliminating the need to overrate the voltage divider circuit currents, a three- to four-fold reduction in power consumption can be gained.

BRIEF DESCRIPTION OF THE DRAWINGS

Further advantages and novel features of the present invention will be apparent from the following detailed description of the invention and the accompanying drawings wherein.

DETAILED DESCRIPTION OF PREFERRED EMBODIMENTS

The present invention describes an improved method of biasing photomultiplier tubes and related devices by reducing the power consumption and current draw, and providing more stable and more optimal electrode bias voltages. An aspect of the invention is based on partitioning the voltage divider network into sections that can be independently sourced by the voltage multiplier circuit. For example, if the high voltage −HV produced by the voltage multiplier is −1100 volts, and the photomultiplier tube has, for example, twelve electrodes including a photocathode, an anode, and ten dynodes, the voltage divider circuit can be used to create eleven bias levels (ground, −100 volts, −200 volts, −300 volts, −400 volts, −500 volts, −600 volts, −700 volts, −800 volts, −900 volts, −1000 volts, and −1100 volts). In practice, the voltage levels so produced do not necessarily have to be evenly spaced. Further, the voltage divider circuits can designed independently to produce voltage bias levels specifically optimized for the load characteristics and saturation behavior of particular electrodes.

Figure 5:
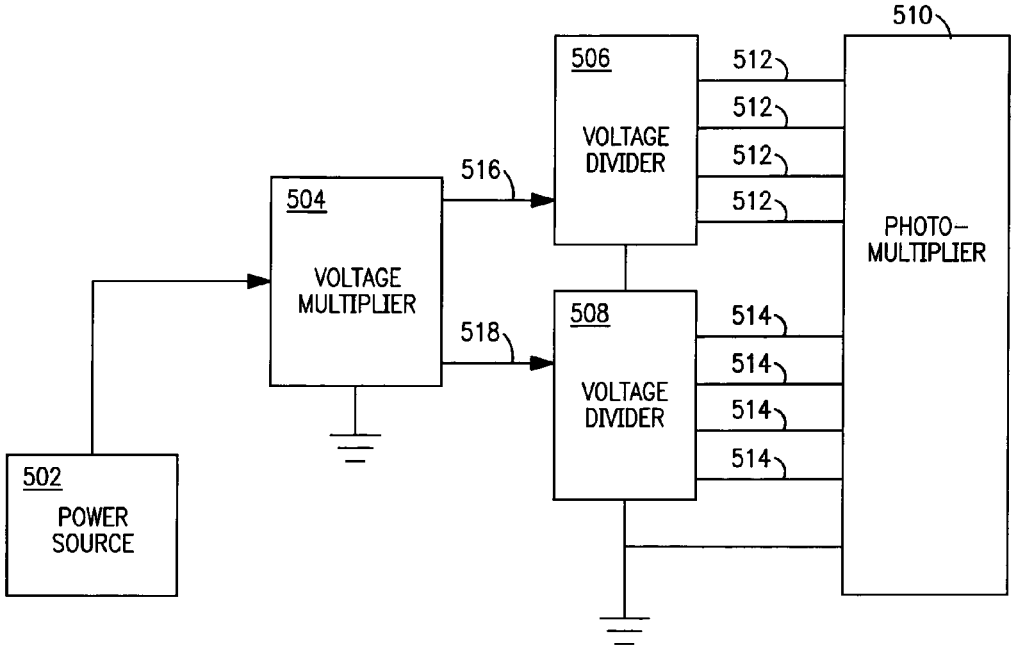
FIG. 5 is a schematic overview of the main functional blocks of the invention.

Referring now to FIG. 5 there is shown a functional block diagram of a photomultiplier and associated voltage biasing circuit according to the present invention. The voltage biasing circuit includes a power source 502, a voltage multiplier circuit 504, and two voltage divider sections 506 and 508 that produce several voltage levels to bias the electrodes of a photomultiplier 510. Many known voltage multiplier circuits have several stages and generate several voltage potentials of intermediate value—between ground and the highest potential generated—in addition to −HV. These intermediate voltages are available at nodes accessible for connections to one or more external devices. The present invention exploits this feature of voltage multiplier circuits. In the arrangement shown in FIG. 5, two distinct high-voltage taps 516 and 518 are provided by the voltage multiplier circuit to independently source voltage divider network sections 506 and 508. This concept can be extended to include three or more voltage divider sections. The voltage divider 506 produces several voltage levels at ports 512 for the front-end electrodes of the photomultiplier tube 510 including the photocathode and the several dynodes in close proximity to the photocathode. Concurrently, voltage divider 508 produces several voltage levels at ports 514 to bias the back-end of the photomultiplier tube including the dynodes near the anode. Because the voltage divider sections 506 and 508 can be optimized independently according to the distinct electrode loading characteristics of the front-end and back-end of a photomultiplier tube, respectively.

Figure 6:
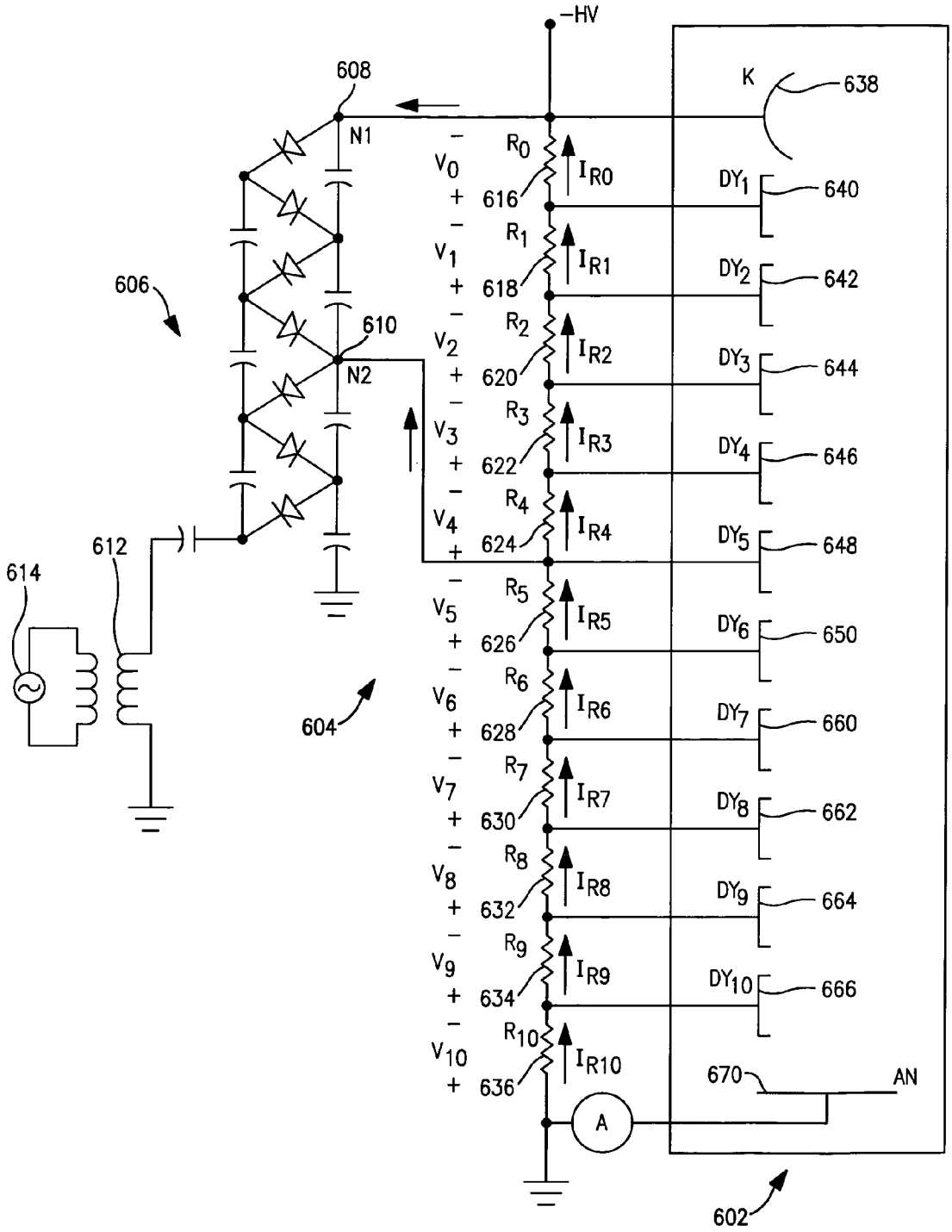
FIG. 6 is a schematic diagram of a first embodiment of a photomultiplier tube with an electrode biasing circuit in accordance with the present invention.

As a specific but not exclusive implementation of certain aspects of the invention, FIG. 6 shows a photomultiplier tube 602 biased with a voltage divider network 604 sourced with a 4-stage voltage multiplier circuit 606, i.e., a voltage quadrupler. In contrast to the other photomultiplier tube biasing circuits shown in FIGS. 1, 2, 3, and 4 that use only the highest voltage output of the voltage multiplier circuit, the voltage divider circuitry of FIG. 6 uses both the high-voltage output of the voltage multiplier available at node 608 and an intermediate voltage available at node 610.

The voltage multiplier circuit creates a voltage that is approximately some multiple of that provided by the external power source. It is generally possible to access both this voltage, and a voltage that is one-half this voltage. Thus, for example, a voltage multiplier with a nominal output of −1000 volts will also have a node at a potential of −500 volts that can be tapped for sourcing the voltage divider network. The particular type of voltage multiplier circuit shown in FIG. 6 is a Cockcroft-Walton multiplier circuit commonly used in commercial television sets and employs a transformer 612 and an alternating current source 614. Other types of voltage multiplier circuits including Greinacher and Villard voltage doubling circuits, and the Villard cascade circuit are similar in that intermediate voltage values are available. Three-phase multiplier circuits and high-voltage step up transformers with center taps and rectifying circuitry would also be workable in this regard. Descriptions of voltage multiplier circuits can be found in "Power Electronics Handbook" (Academic Press, San Diego, Calif., 2001).

In FIG. 6, the voltage difference between a maximum output voltage at node 608 and an intermediate voltage at node 610 is divided across a string of five series-connected resistors 616, 618, 620, 622, 624 that generate five voltage differences V0, V1, V2, V3, V4 to bias the photocathode 638 and dynodes 640, 642, 644, 646, 648.

Similarly, the voltage difference between an intermediate voltage at node 610 and ground potential 612 is divided across a string of six series-connected resistors 626, 628, 630, 632, 634, and 636 that generate six voltage differences V5, V6, V7, V8, V9, and V10 to bias the dynodes 648, 650, 652, 554, 656 and 658 and anode 660.

Thus, the voltage divider circuit has been partitioned into two sections: a front-end section comprised of a string of series-connected resistors 616, 618, 620, 622, 624, and a back-end section comprised of a string of series-connected resistors 626, 628, 630, 632, 634, and 636. Further, the voltage potential differences across these two strings are independently sourced by stages of the voltage multiplier circuit. Therefore, the currents and voltages of each string can be optimized separately. The currents in photocathode 638, and its adjacent dynodes 640, 642, 644, 646, and 648 are relatively small, often in the picoampere or nanoampere range. Thus, if the voltage biases V0, V1, V2, V3, and V4 are established by currents IR0, IR1, IR2, IR3, and IR4 in the microampere range, variations in electrode currents with light intensity will not significantly perturb these voltage biases. This is in accord with the stipulation that variations in electrode current be small relative to the currents through the resistors that establish the voltage differences between those electrodes so as not to significantly alter those same voltage differences. Otherwise, such electrode loading will produce saturation effects resulting in non-linear photomultiplier tube behavior.

For the example, in the circuit of FIG. 6, if node voltage 608 is preferably about −1000 volts, and node voltage N2 610 is preferably about −500 volts, and further, if resistors 616, 618, 620, 622, and 624 are the same and preferably about 5 mega-ohms, then the nominal currents IR0, IR1, IR2, IR3, and IR4 through these resistors are approximately the same and equal to about 20 microamps. Further, the voltage bias difference between each electrode 638, 640, 642, 644, and 646 is about 100 volts. In the usual operation of the photomultiplier under typical incident radiation levels, the small currents in these electrodes is a factor of hundred or more smaller than the currents established through resistors. Thus, in the voltage biasing scheme of FIG. 6, and for the example resistor values stated, the voltages across resistors do not greatly change with electrode current levels, or equivalently, with radiation intensity levels as normally encountered in typical photomultiplier tube applications.

The optimization of the back-end of the voltage divider network shown in FIG. 6 addresses the loading and saturation characteristics of the anode and its adjacent dynodes. In response to irradiation of the photocathode, the currents in dynodes 650, 652, 654, 656, 658 and the anode 670 are substantially larger than the currents in the photocathode and dynodes 638, 640, 642, 644, and 646. Variations in these electrode currents can significantly affect the bias voltages established across resistors 626, 628, 630, 632, and 634. In order to avoid saturation effects, the currents through those resistors should be about 100 times larger than the corresponding electrode currents. As an example, the resistors 626, 628, 630, 632, and 634 could have values of about 500 kilo-ohms each, giving a nominal string current, neglecting electrode loading, of about 200 microamps. Although such relatively high resistor currents IR5, IR6, IR7, IR8, IR9, and IR10 are needed to avoid saturation effects, this requirement applies only to the backend string of resistors of the voltage divider network. By separately sourcing the front-end and back-end strings using the intermediate voltage level at node 610, the resistor currents in the front-end section can be made much smaller than those in the back-end.

Figure 1:
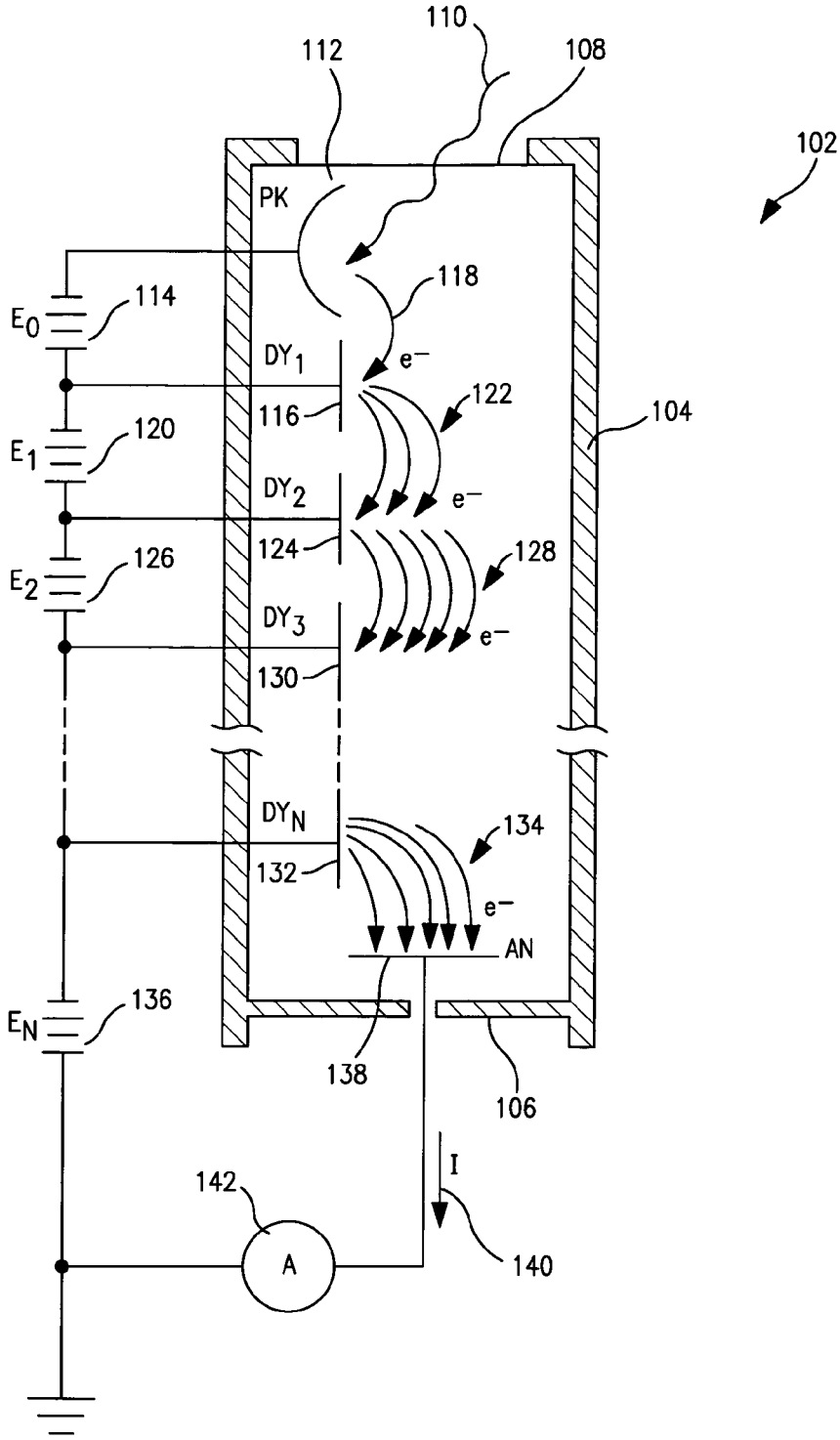
FIG. 1 (PRIOR ART)
FIG. 1 is a schematic diagram of an idealized photomultiplier tube.
Figure 2:
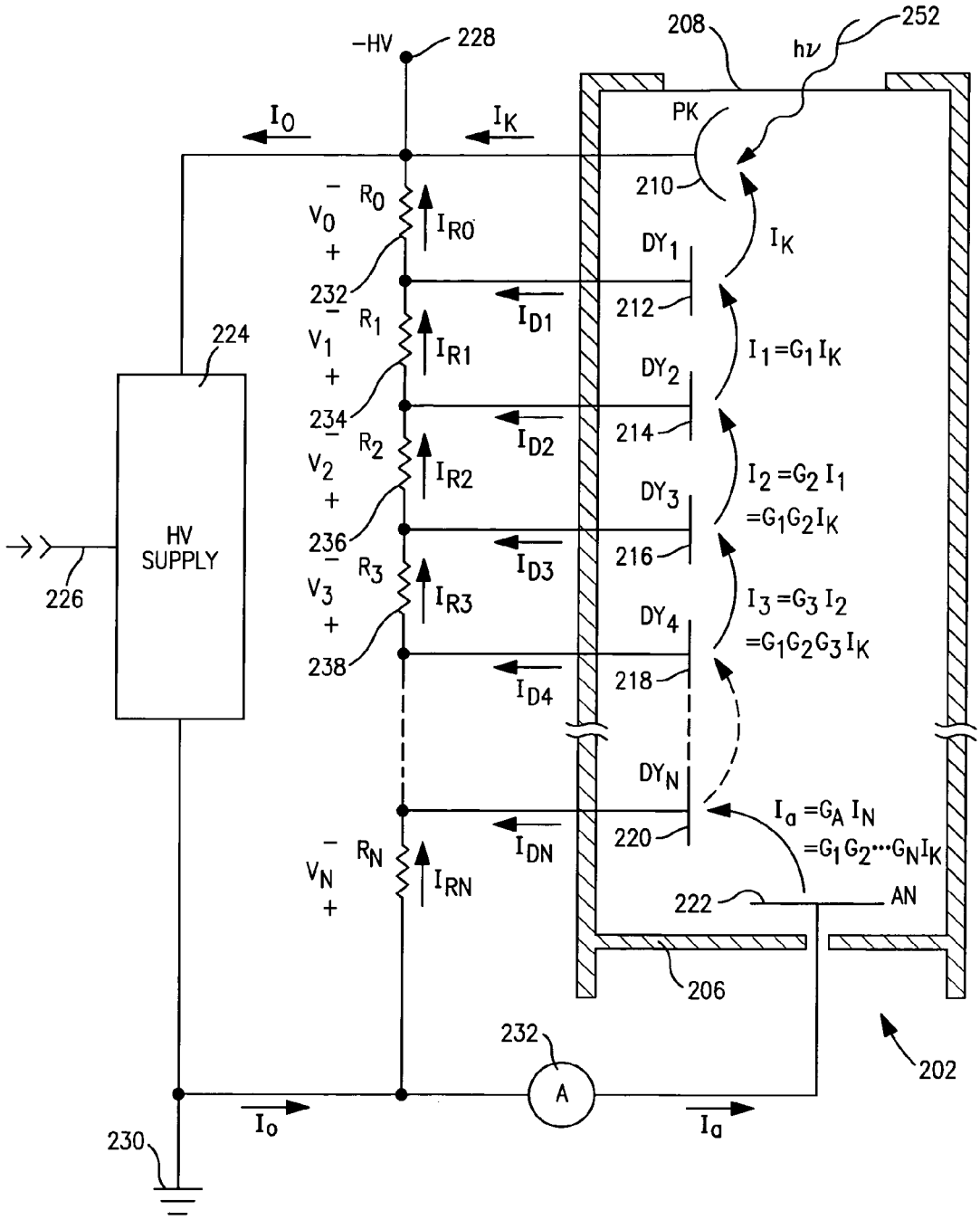
FIG. 2 (PRIOR ART)
FIG. 2 is a schematic diagram of a known photomultiplier tube having a totally resistive voltage divider circuit.
Figure 3:
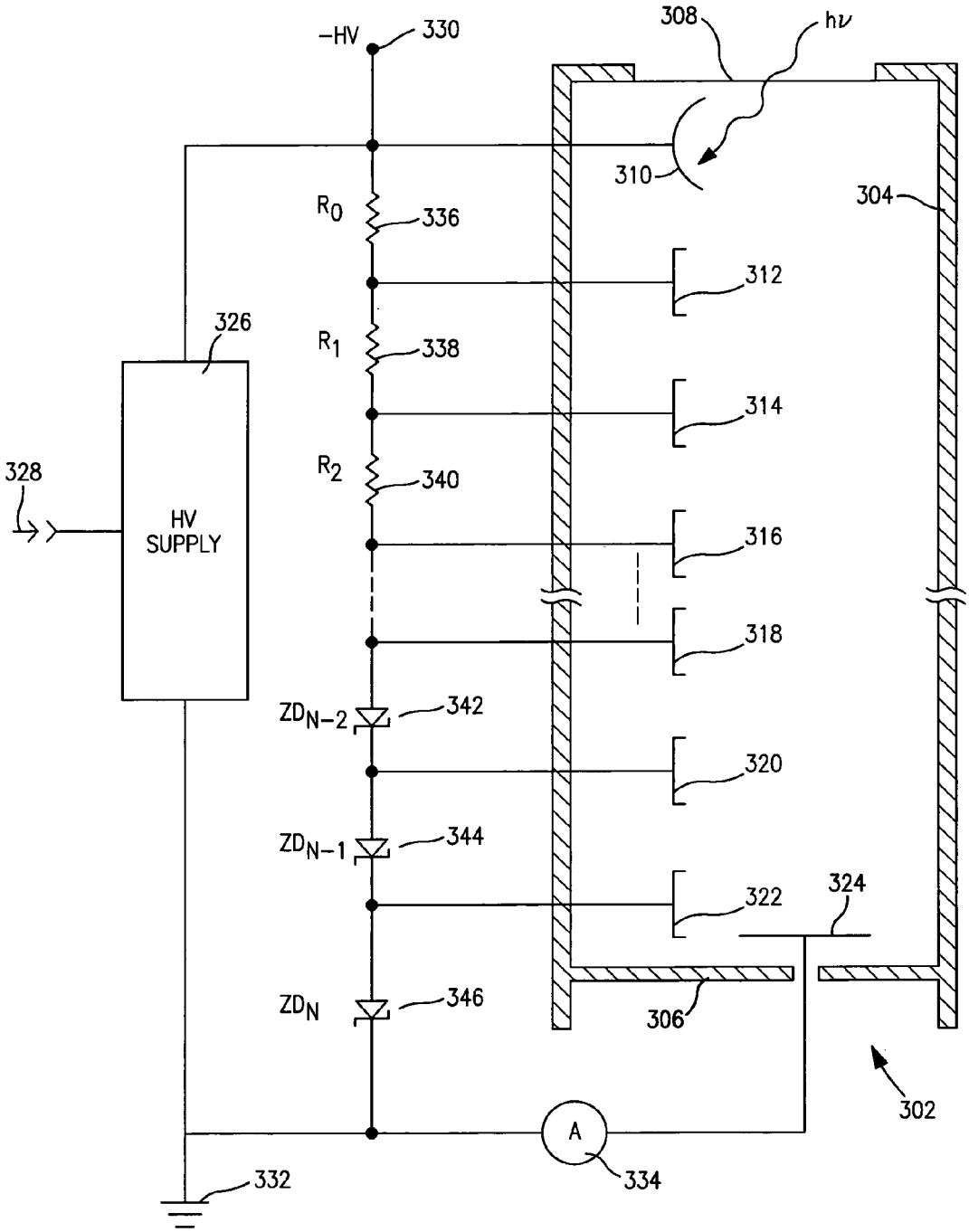
FIG. 3 (PRIOR ART)
FIG. 3 is a schematic diagram of a known photomultiplier tube with a voltage divider circuit having a first stage that includes only resistors and a second stage that includes Zener diodes.
Figure 4:
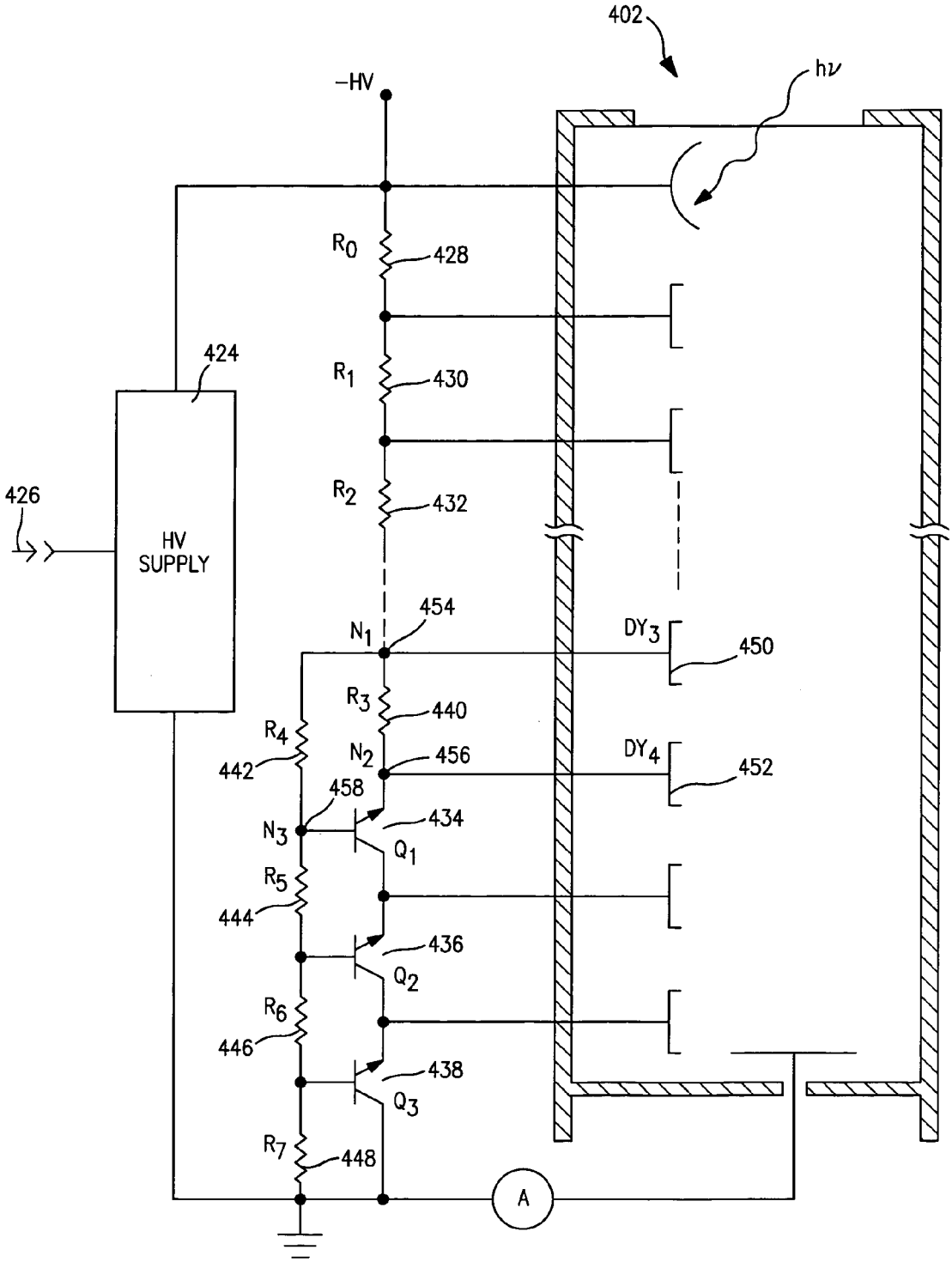
FIG. 4 (PRIOR ART)
FIG. 4 is a schematic diagram of a known photomultiplier tube with a voltage divider circuit having a first stage that includes only resistors and a second stage that includes transistors.
Figure 7:
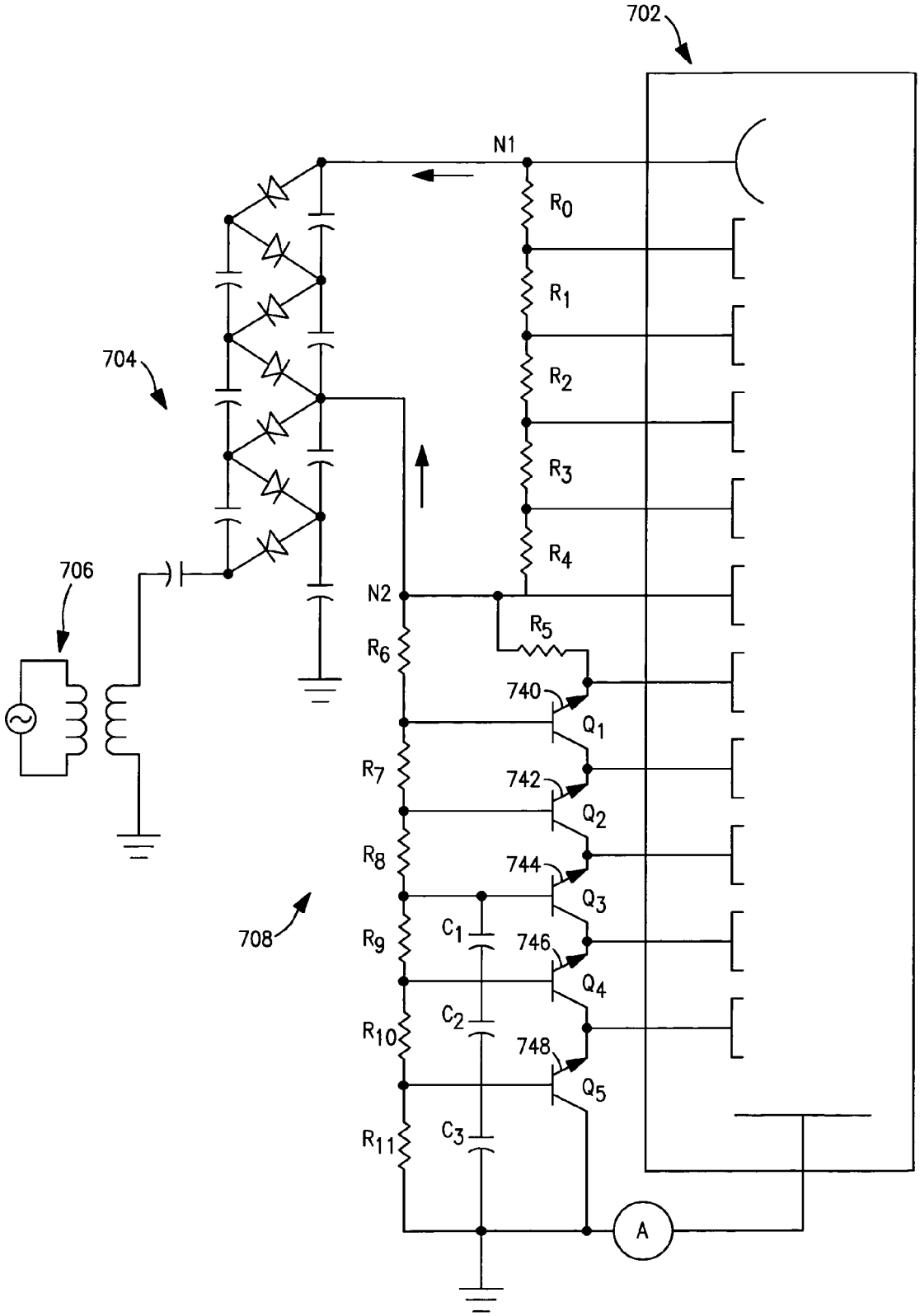
FIG. 7 is a schematic diagram of a second embodiment of a photomultiplier tube with an electrode biasing circuit in accordance with the present invention.

The photomultiplier tube biasing circuitry of FIG. 7 is similar in concept to that of FIG. 6, except that, similar to the electrode biasing circuit described by FIG. 4, the back-end section of the voltage divider circuit uses transistor loads in an emitter-follower configuration in place of purely resistive loads. As with the other circuits described herein, the photomultiplier tube 702 is biased with a voltage divider network 708 which is sourced by a voltage multiplier 708 powered by a line voltage 706. The active transistor loads 740, 742, 744, 746, and 748 serve to stabilize the bias voltages of the electrodes, thus making the photomultiplier tube gain more resilient to changes in incident radiation. Further, and as described with respect to the circuit of FIG. 6, the partitioning of the voltage divider network into two separate strings that are independently sourced by the voltage multiplier circuit allows smaller current levels in front-end string, resulting in an overall reduction in current drawn from the power supply.

Figure 8:
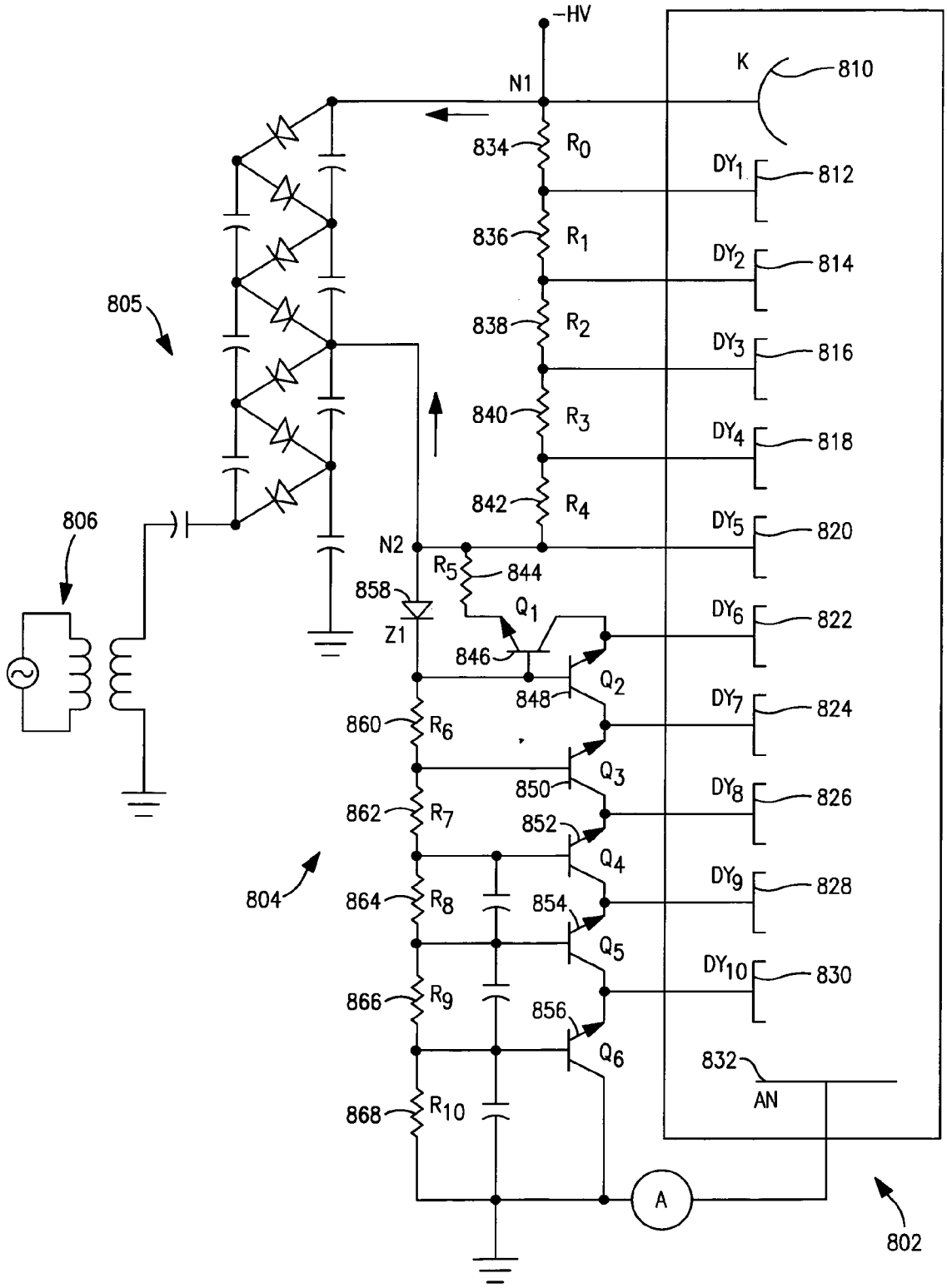
FIG. 8 is a schematic diagram of a third embodiment of a photomultiplier tube with an electrode biasing circuit in accordance with the present invention.

FIG. 8 shows a further improvement on the voltage biasing circuit of FIG. 7, where a current source is included to set the current through the transistors 848, 850, 852, 854, and 856. The current source includes a transistor 846, Zener diode 858, and resistor 844.

The photomultiplier tube biasing circuitry of FIG. 8 maintains optimal biasing of the electrodes even when the supply voltage or thevoltage multiplier output is adjusted. This result from the use of a current source to establish the transistor bias levels. The Zener diode 858 tends to hold the emitter-base voltage of transistor 846 to a set value, independent of the voltage at node 872. The collector-emitter voltages of transistors 848, 850, 852, and 854 can thus be set to an optimum value to avoid saturation effects in dynodes 822, 824, 826, 828, and 830. Thus, the current levels set to bias the electrodes for a high value of −HV do not have to be made larger than needed in anticipation of a possible reduction in power supply voltage.

Figure 9:
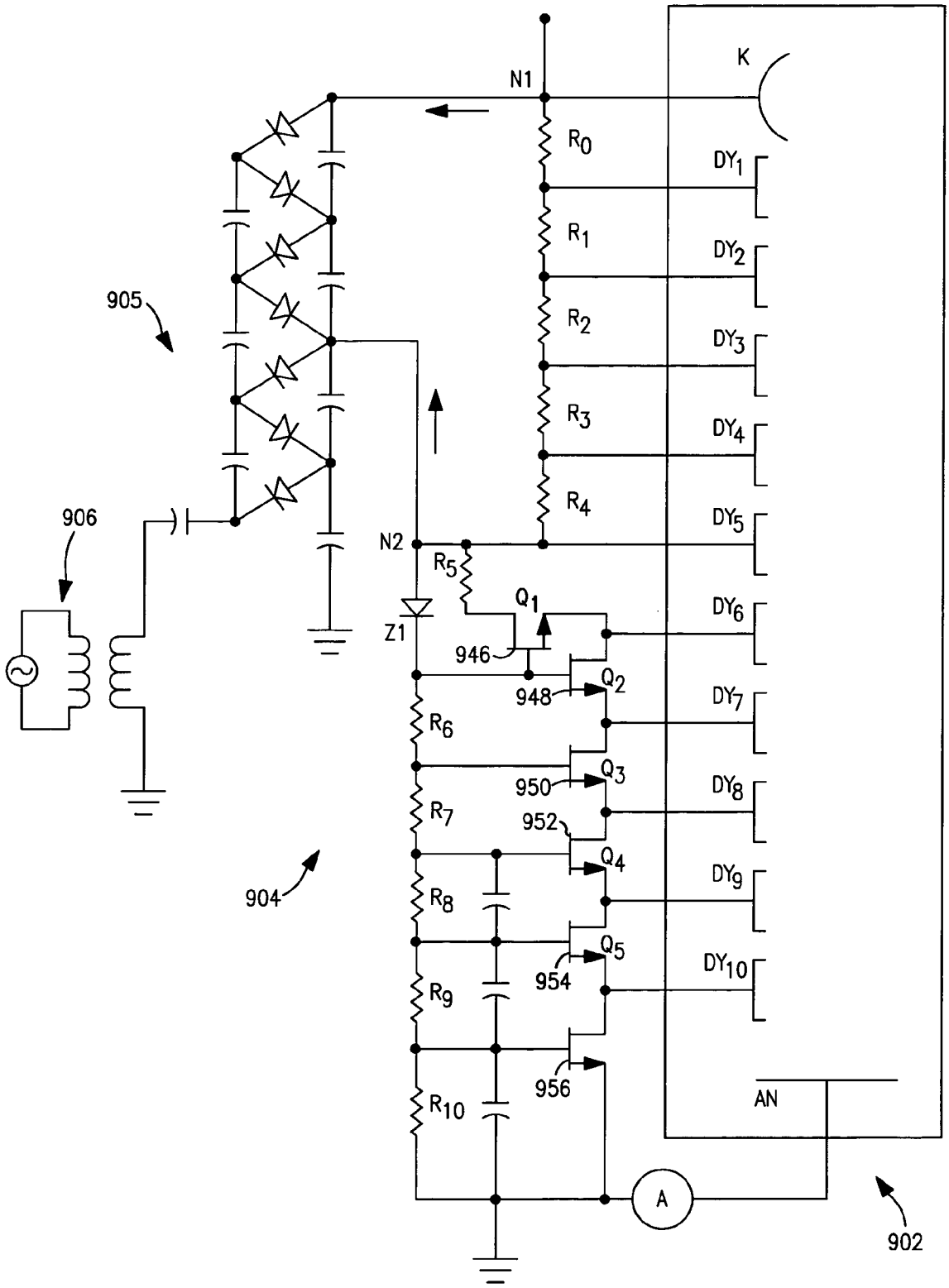
FIG. 9 is a schematic diagram of a fourth embodiment of a photomultiplier tube with an electrode biasing circuit in accordance with the present invention.

In another embodiment a functionally equivalent, but differently configured circuit can be realized using field-effect transistors in place of bipolar transistors as shown in FIG. 9. The field-effect transistors 946, 948, 950, 952, 954, and 956 are incorporated into the voltage-divider network. The selection between bipolar and field-effect transistors can be based on a number of factors including cost, temperature of operation, load characteristics of the dynodes, power consumption and current draw from the power supply, susceptibility to noise and switching transients.

Figure 10:
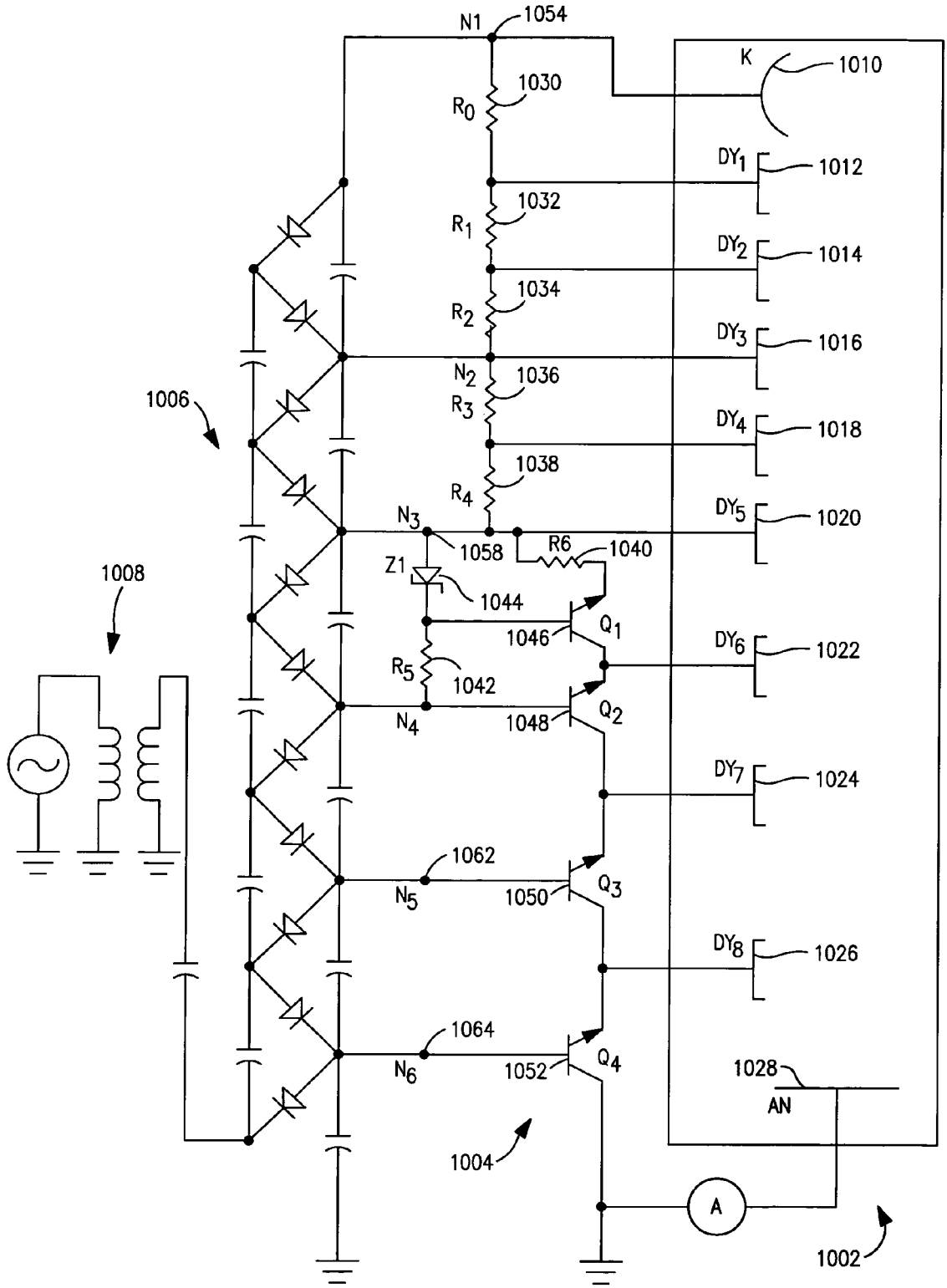
FIG. 10 is a schematic diagram of a fifth embodiment of a photomultiplier tube with an electrode biasing circuit in accordance with the present invention.

A more versatile and comprehensive implementation of the features of a biasing circuit in accordance with the invention is shown in FIG. 10 which includes a photomultiplier tube 1002 biased by a voltage divider circuit 1004 sourced by a multi-stage voltage multiplier circuit 1006 that is powered by line voltage 1010.

The photomultiplier biasing circuit of FIG. 10 combines several from the previously described features and more fully exploits the multiple output voltages available from the voltage multiplier circuit 1006 to source sections of the voltage divider circuit 1004. In FIG. 10, successive voltages produced by six stages of a voltage multiplier circuit are used to source six sections of voltage divider circuits. The first section of the voltage divider includes a string of series-connected resistors 1030, 1032, and 1034 and is sourced by the voltage difference between nodes 1054 and 1056 of the voltage multiplier circuit. This section provides voltage biases for the photocathode and dynodes 1010 and 1012. A second section of the voltage divider circuit includes a second string of series-connected resistors 1036 and 1038 sourced by the voltage difference between nodes 1056 and 1058. This section provides bias voltages for dynodes 1016 and 1018. A third section of the voltage divider circuit includes a transistor 1046 connected in an emitter-follower configuration that acts as a current source. The base voltage of the transistor 1046 is established by Zener diode 1044. Emitter resistor 1040 provides negative feedback to stabilize the collector current of transistor 1046. The collector current established by transistor 1046 clamps the collector-emitter voltages of transistors 1048, 1050, and 1052, as desired in order to maintain stabilized voltage differences between dynodes 1022, 1024, 1026, and the anode 1028. The circuit of FIG. 10 provide considerable latitude for reducing the current drawn from the power supply, thus reducing power consumption, while permitting the realization of highly-stabilized voltage biases to the electrodes of the photomultiplier tube.

It will be recognized by those skilled in the art that changes or modifications may be made to the above-described embodiments without departing from the broad inventive concepts of the invention. For example, the transistors utilized in the voltage divider networks may be either of the bipolar or field-effect type. Further, there are well-known variations on methods of biasing transistors for function as stabilized active loads and current sources. These variations are recognized within the scope of the invention. Moreover, the number of stages of the voltage multiplier circuit, the number of sections of the voltage divider circuit, and the particular wiring of the voltage multiplier circuit connections to the voltage divider circuit are considered obvious variations of the present invention. It is understood therefore, that the invention is not limited to the particular embodiment which is described, but is intended to cover all modifications and changes within the scope and spirit of the invention as described and defined in the amended claims.

What is claimed:

1. A photomultiplier tube comprising:

a photocathode;

first and second dynodes;

an anode; and an electrode biasing circuit comprising a voltage multiplier circuit adapted for connection to a source of electric power, said voltage multiplier circuit having first and second voltage taps for providing first and second tap voltages;

a first stage voltage divider network operatively connected to the first voltage tap of said voltage multiplier circuit; and a second stage voltage divider network operatively connected to the second voltage tap of said voltage multiplier circuit;

said first stage voltage divider being operatively connected to said photocathode and to said first dynode for providing biasing voltages thereto, and said second stage voltage divider network being operatively connected to said second dynode and to said anode for providing biasing voltages thereto.

2. The photomultiplier tube of claim 1 wherein the first stage voltage divider network comprises an electrical resistor connected between said photocathode and said first dynode and the second stage voltage divider network comprises a second electrical resistor connected between said second dynode and said anode.

3. The photomultiplier tube claim 1 wherein the first dynode comprises a plurality of first dynodes and the second dynode comprises a plurality of second dynodes and said first stage voltage divider network is operative connected to each of said plurality of first dynodes for providing biasing voltages thereto and said second voltage divider network is operatively connected to each of said plurality of second dynodes for providing biasing voltages thereto.

4. The photomultiplier tube of claim 3 wherein the first stage voltage divider network comprises a first plurality of electrical resistors each connected between adjacent first dynodes and the second stage voltage divider network comprises a second plurality of electrical resistors each connected between adjacent second dynodes.

5. The photomultiplier tube of claim 1 wherein the first stage voltage divider network comprises an electrical resistor connected between said photocathode and said first dynode and the second stage voltage divider network comprises a transistor connected in an emitter-follower configuration between said second dynode and said anode.

6. The photomultiplier tube of claim 3 wherein the first stage voltage divider network comprises a plurality of electrical resistors each connected between adjacent first dynodes and the second stage voltage divider network comprises a plurality of transistors each connected in an emitter-follower configuration between adjacent second dynodes.

7. The photomultiplier of claim 6 wherein the second stage voltage divider network comprises a current source operatively connected to said plurality of transistors.

8. The photomultiplier tube of claim 7 wherein said current source comprises a bipolar transistor that provides a substantially constant collector current to said plurality of transistors when in operation.

9. The photomultiplier tube of claim 7 wherein said current source comprises a field-effect transistor that provides a substantially constant collector current to said plurality of transistors when in operation.

10. The photomultiplier tube of claim 7 wherein the current source comprises a transistor, a Zener diode, and one or more resistors which are connected such that in operation, the transistor is biased to provide a substantially constant collector current to said plurality of transistors.

* * * * *